US012716241B1

(12) United States Patent
Zimmerle

(10) Patent No.: US 12,716,241 B1
(45) Date of Patent: Aug. 25, 2026

(54) DEVICE AND METHOD FOR ROOF PANEL ALIGNMENT

(71) Applicant: Phillip E. Zimmerle, Bunnell, FL (US)

(72) Inventor: Phillip E. Zimmerle, Bunnell, FL (US)

( * ) Notice: Subject to any disclaimer, the term of this patent is extended or adjusted under 35 U.S.C. 154(b) by 0 days.

(21) Appl. No.: 19/267,727

(22) Filed: Jul. 14, 2025

(51) Int. Cl.
*E04D 15/02* (2006.01)

(52) U.S. Cl.
CPC ..... *E04D 15/025* (2013.01)

(58) Field of Classification Search
CPC ..... E04D 15/025
See application file for complete search history.

(56) References Cited

U.S. PATENT DOCUMENTS 3,166,961 A 1/1965 Chaplin
3,664,025 A * 5/1972 Barto ..... B43L 9/04 33/42
4,183,144 A * 1/1980 Barnett, III ..... G01B 3/30 33/649
4,291,467 A * 9/1981 Shultz, Jr. ..... B43L 13/22 33/DIG. 1
4,443,949 A * 4/1984 Newton ..... A47G 1/205 33/562
4,478,016 A * 10/1984 Allen ..... E04F 21/0015 52/745.15
5,606,837 A * 3/1997 Holizlander ..... E04G 21/1891 52/696
5,628,119 A * 5/1997 Bingham ..... E04G 21/1891 269/904
6,199,288 B1 * 3/2001 Gregory ..... B25H 7/02 33/484
6,332,299 B1 * 12/2001 Stewart, III ..... E04C 3/292 52/696
6,378,223 B1 * 4/2002 Korich ..... G01B 3/02 33/649
6,405,446 B1 * 6/2002 Monroe ..... B25H 7/00 33/666
6,560,945 B1 5/2003 Carpenter
6,708,417 B1 * 3/2004 Wilkins ..... B25H 7/04 33/476
7,617,612 B2 * 11/2009 Brizendine ..... E04D 15/00 33/645
7,681,324 B2 3/2010 Hooks
(Continued)

FOREIGN PATENT DOCUMENTS

DE 1031496 B 6/1958
DE 19836837 A1 * 12/1999 ..... E04G 3/28
(Continued)

OTHER PUBLICATIONS

Tough Trade Tools, Ridge-R3:10, webpage <https://toughtradetools.com/product/ridge-r310/> retrieved on Jun. 20, 2024.

*Primary Examiner* — Yaritza Guadalupe-McCall
(74) *Attorney, Agent, or Firm* — Lippes Mathias LLP; Mitchell Ghaneie; Josephine Chen

(57) ABSTRACT

The present invention provides a device for roof panel alignment comprising a longitudinal guide plate comprising a plurality of apertures spaced apart from each other and boring through the longitudinal guide plate; the longitudinal guide plate having increments along a length thereof; and a securement mechanism coupled to a first end of the longitudinal guide plate for rotation between a first position and a second position perpendicular to the first position.

7 Claims, 6 Drawing Sheets

(56) References Cited

U.S. PATENT DOCUMENTS

| | | | | |
|---|---|---|---|---|
| 8,584,372 | B2 * | 11/2013 | Stoffel | G01B 5/25 33/832 |
| 12,416,496 | B1 * | 9/2025 | Collins | G01C 9/26 |
| 2003/0088992 | A1 | 5/2003 | Nelson et al. | |
| 2004/0200087 | A1 | 10/2004 | Killen | |
| 2006/0010703 | A1 * | 1/2006 | Gauthier | E04G 21/1891 33/613 |
| 2009/0139184 | A1 * | 6/2009 | Brizendine | E04D 15/025 52/749.12 |
| 2011/0088274 | A1 * | 4/2011 | Lonergan | E04B 9/006 33/613 |
| 2013/0118022 | A1 * | 5/2013 | Propp | B25H 7/04 33/669 |
| 2016/0024791 | A1 * | 1/2016 | Reno | E04C 3/02 52/745.21 |
| 2017/0209985 | A1 * | 7/2017 | Burnard | B25B 5/166 |
| 2021/0388625 | A1 * | 12/2021 | Baker | E04F 13/0885 |

FOREIGN PATENT DOCUMENTS

| | | | | |
|---|---|---|---|---|
| GB | 2319284 | A * | 5/1998 | E04D 15/025 |
| GB | 2377200 | A | 1/2003 | |
| WO | 2008023139 | A1 | 2/2008 | |
| WO | 2019036807 | A1 | 2/2019 | |

* cited by examiner

DEVICE AND METHOD FOR ROOF PANEL ALIGNMENT

FIELD OF THE DISCLOSURE

The present disclosure pertains to the field of roofing. More specifically, the present disclosure pertains to a device and method for aligning roof panels during roof installation.

BACKGROUND

Roof panel installation is an essential part of construction, because the roof not only shields a building against weather exposure, but also prevents damage from water leakage. A key factor for roof installation is roof panels being properly aligned and secured to a roofing frame. The proper alignment of roof panels not only enhances structural integrity of the building, but also ensures efficient water flow off the roof and prevents water accumulation at uneven seams or leaks at gaps due to unproper alignment of the roof panels. Over time, aligned roof panels enhance durability of the roof, and help maintain long-term performance of the roof.

Typically, roof alignments (specifically in the installation of metal roof panels) are secured in a partially overlapping manner, which involves positioning the roof panels onto roof frame members (i.e. purlin) of the roof, securing the subsequent panel over the previous panel, and securing the panel to an underlying horizontal frame member of the roof frame members with fasteners (i.e. screws or nails).

Nevertheless, it may be challenging for a roof panel installer to accurately determine where the fasteners should be positioned, and to ensure the fasteners are evenly spaced and aligned along the purlins, as the purlins are not visible once the roof panels are laid over them. Installers often depend on observing an adjacent portion of the roof frame member that is visible, and setting the visible portion of the roof frame member as a reference line. However, establishing the reference line by visual judgment may increase the risk of misalignment or inconsistent spacing of the fasteners. To address this issue, existing methods include adding chalk lines to the panels as reference lines marking where the screw should be placed prior to installation. However, marking chalk lines to the roof panels is an additional step, and chalk lines may smudge or blur in hot or humid conditions.

SUMMARY OF THE DISCLOSURE

The following is a concise summary of the present disclosure presented herein with the primary aim of providing a preliminary understanding of certain aspects of the present disclosure. It should be noted, however, that this summary is not intended to serve as a comprehensive overview of the present disclosure, nor does it seek to identify or describe any critical or significant elements of the present disclosure or the boundaries of its scope. Its sole purpose is to provide a rudimentary understanding of the present disclosure's concepts and features, which will be expounded upon in greater detail in the ensuing sections.

In some embodiments, a device for roof panel alignment comprises a longitudinal guide plate comprising a plurality of apertures spaced apart from each other and boring through the longitudinal guide plate; the longitudinal guide plate having increments along a length thereof; and a securement mechanism coupled to a first end of the longitudinal guide plate for rotation between a first position and a second position perpendicular to the first position.

In some embodiments, a device for roof panel alignment comprises a longitudinal guide plate comprising a plurality of apertures spaced apart from each other and boring through the longitudinal guide plate; and an interchangeable securement mechanism removably coupled to a first end of the longitudinal guide plate. The interchangeable securement mechanism is selected from a plurality of interchangeable securement mechanisms having different gripping dimensions.

In some embodiments, a device for roof panel alignment comprises a longitudinal guide plate comprising a plurality of apertures spaced apart from each other and boring through the longitudinal guide plate; and securement mechanism coupled to a first end of the longitudinal guide plate.

The present disclosure generally pertains to a device and method that facilitates fast and accurate alignment of roof panels. During installation of the roof panels, roof frame members are often covered by the panel to be mounted. The disclosed device comprises an elongated guide plate that includes a plurality of apertures positioned at predetermined locations that can serve as reference points for positioning and securing fasteners (e.g., screws or nails) that holds the roof panels to the roof frame members. Notably, the disclosed device also features a securement mechanism coupled to one end of the guide plate. Advantageously, to locate the plurality of apertures to the correct location, an installer may effortlessly and efficiently place the disclosed securement mechanism on a horizontal portion the roof frame member that is adjacent to the roof panel to be mounted with the guide plate upon the roof panel to be mounted. The installer can then simply place the fasteners within the aperture and secure the fastener to the roof panel. Since a diameter of the aperture is greater than a diameter of the fastener, upon completion of securing all the required fasteners, the disclosed device can be removed and relocated for installation of the subsequent panel. Consequently, the fasteners are evenly spaced and secured at proper locations, and the installed roof panels are aligned accordingly.

Moreover, in some embodiments, the disclosed device also features at least one magnet that can be attached to metal roof panels, advantageously providing additional securing force beyond the securement mechanism alone.

Furthermore, in some embodiments, the disclosed device includes a guide plate that has increments along a length thereof and the securement mechanism is rotatably coupled to the guide plate for rotation between a first position and a second position perpendicular to the first position. Advantageously, the installer may rotate the securement mechanism to the first position for securing the fasteners and rotate the securement mechanism to the second position for measuring a distance between two horizontal frame members.

The above features and advantages will become apparent from the following detailed description taken with the accompanying drawings.

NUMBERING REFERENCE

100—Roof Panel Alignment Device (the "device")
110—Guide plate
110A—First Surface
110B—Second Surface
112—Apertures
120—Securement Mechanism
120A—Interchangeable Securement Mechanism
120B—Interchangeable Securement Mechanism
122—Base
124—Extension
124A—Extension
124B—Extension
130—Magnet
140—Rotating Mechanism
200—Roof Panel
220—Roof Frame Members
222—Horizontal Frame Member
222A—Underlying Portion
222B—Visible Portion
224—Fastener
L1 Length of Guide Plate
W2—Width of Extension

DETAILED DESCRIPTION OF THE DISCLOSURE

The following detailed description and accompanying drawings provide a comprehensive disclosure of an exemplary embodiment for the purpose of facilitating one of ordinary skill in the relevant art to make and use the disclosure. As such, the detailed description and illustration of the one or more exemplary embodiments presented herein are purely exemplary in nature and are not intended to limit the scope of the disclosure or its protection in any matter. It is further noted that the drawings may not be to scale, and in some cases, certain details may be omitted which are not necessary for an understanding of the present disclosure, such as conventional details of fabrication and assembly. Furthermore, there is no intention to be bound by any expressed or implied theory presented in the preceding technical field, background, brief summary or the following detailed description.

Figure 1:
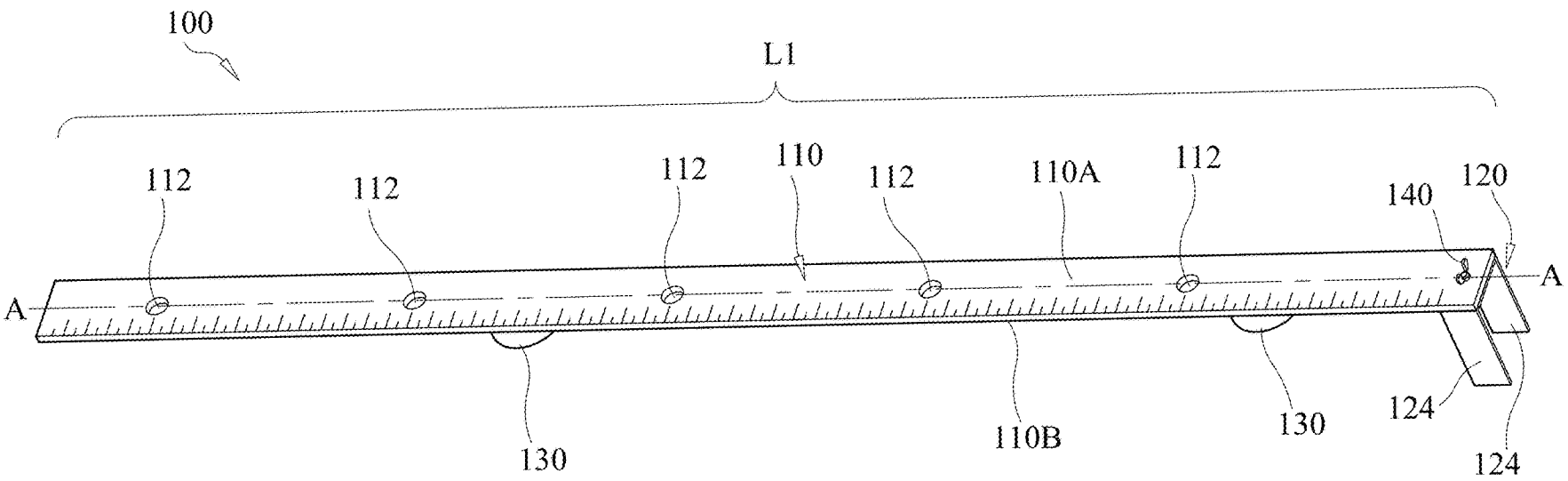
FIG. 1 illustrates a first perspective view of a non-limiting exemplary embodiment (the "exemplary embodiment") of a device for roof panel alignment (the "device").

For purposes of description herein, the terms "top", "bottom" and derivatives thereof shall relate to the device as oriented in FIG. 1. Furthermore, there is no intention to be bound by any expressed or implied theory presented in the preceding technical field, background, brief summary or the following detailed description.

Providing reference points or lines indicating where screws should be fastened are often necessary during the alignment and installation of roof panels. The following discloses a device and method that facilitates quick and accurate alignment of roof panels.

A non-limiting, exemplary embodiment (herein after as the "exemplary embodiment") of a device for roof panel alignment 100 (herein after referred to as "the device") is disclosed herein. The exemplary embodiment of the device 100 provides quick positioning of reference holes for fasteners to secure roof panels to roof frame members.

Referring to FIG. 1, FIG. 1 illustrates a first perspective view of the device 100, according to the exemplary embodiment. The device 100 comprises an elongated guide plate 110 having a first surface 110A (i.e., a top surface) and an opposing second surface 110B (i.e., a bottom surface), and a securement mechanism 120 coupled to one end of the second surface 112B. The guide plate 110 has increments along a length L1 thereof, and further comprises a plurality of apertures 112 (five of which are shown in FIG. 1, although any suitable number of apertures may be provided) predrilled at predetermined locations. The plurality of apertures 112 are aligned along a longitudinal axis A of the guide plate 100; although any suitable arrangement is contemplated. The guide plate 110, as shown in FIG. 1, has a substantially rectangular configuration (although any suitable shape is contemplated) and may be constructed of rigid materials including, but not limited to, metal, plastic and wood.

Figure 2:
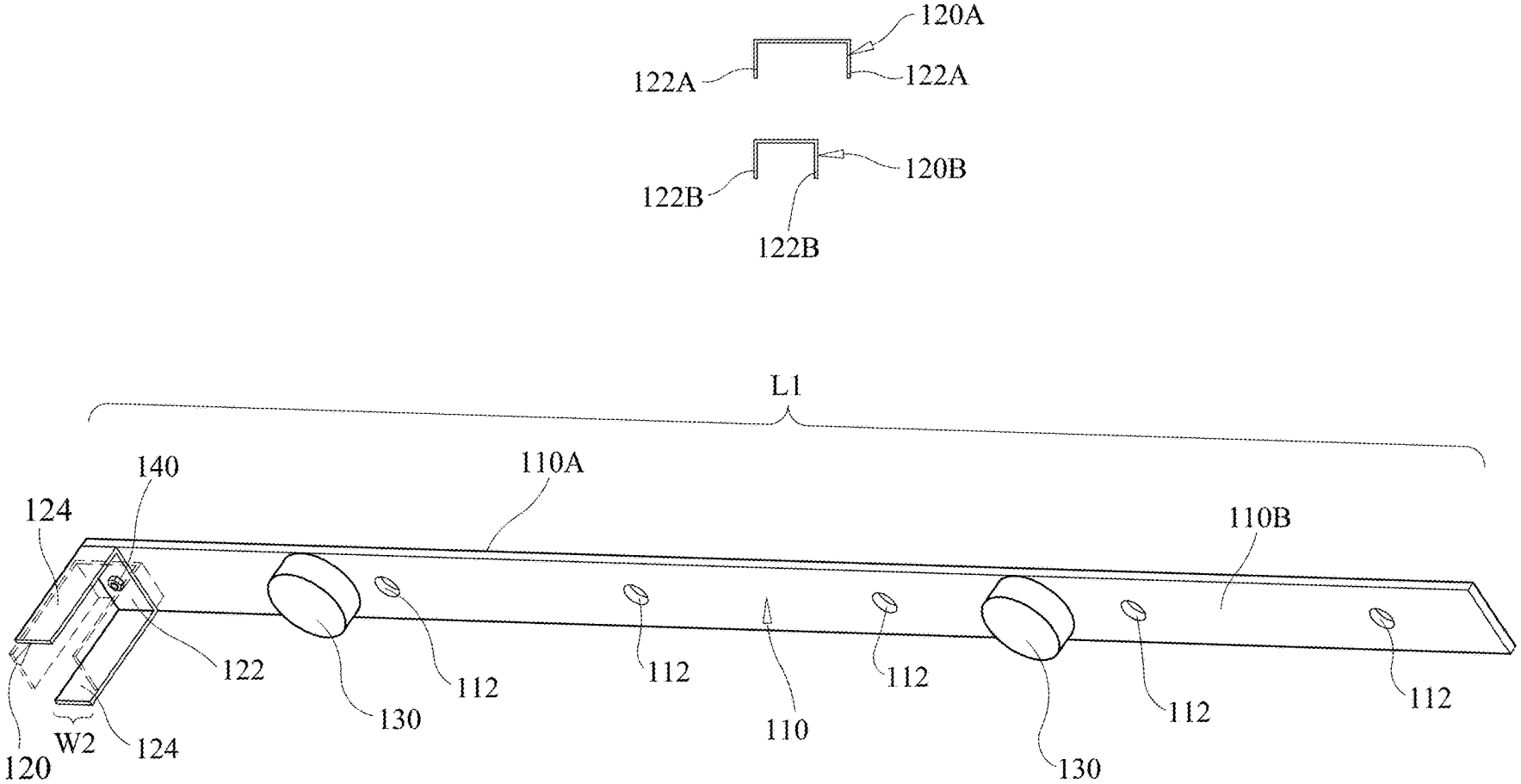
FIG. 2 illustrates a second perspective view of the device of FIG. 1 with interchangeable securement mechanisms.

Referring to FIG. 2, FIG. 2 illustrates a second perspective view of the device 100. As shown in FIG. 2, the securement mechanism 120 comprises two extensions 124 extending orthogonally relative to the guide plate 110. Preferably, the securement mechanism 120 has a gripping dimension comprising a distance of the two extensions 124 that corresponds to a dimension of one of the roof frame members (not shown). For example, FIG. 2 shows that the securement mechanism 120 of the exemplary embodiment has substantially square-bottomed U-shape configuration (although any suitable shape is contemplated) having a base 122 with the two extensions 124 extending therefrom. In some embodiments, the securement mechanism 120 is rotatably coupled to the guide plate 110 by a lockable rotating mechanism 140 configured to restrict rotation of the securement mechanism 120 when tightened to allow rotation of the securement mechanism 120 when loosened. As shown in FIG. 2, the lockable rotating mechanism 140 can be a wing screw, although any suitable mechanism may be provided). The securement mechanism 120 may rotate between a first position (for example, a width W2 of the extension 124 parallel to the length L1 of the guide plate 110) and a second position (for example, the width W2 of the extension 124 perpendicular to the length L1 of the guide plate 110, diagrammatically shown as dotted lines) perpendicular to the first position. In some embodiments, the securement mechanism 120 is interchangeable with a plurality of interchangeable securement mechanisms 120A, 120B having different gripping dimensions. For example, the each securement mechanism 120A, 120B can have two extensions 124, where the distance between the two extensions 124 is different for each securement mechanism 120A, 120B. Advantageously, an installer may choose the securement mechanism 120 that has a suitable gripping dimension. For example, as shown in FIG. 2, the interchangeable securement mechanisms 120A, 120*b* having different gripping dimensions have different distances between the two extensions 122A, 122B. The installer may choose a suitable securement mechanism from the interchangeable securement mechanisms 120A, 120*b* according to a width of the roof frame members and release the rotating mechanism 140 to mount the suitable securement mechanism. To enhance securement of the device 100, in some embodiments, the device 100 may comprise at least one magnet 130 (two are shown) that may be attached to metallic roof panels. It is appreciated that the at least one magnet 130 may alternative be reusable adhesive, such as gel-based or putty adhesives, or suction cups.

Advantageously, when a roof panel to be mounted is partially covering the roof frame members, the securement mechanism 120 can hold on to a portion of one of the roof frame members that is visible and adjacent to the panel to be mounted, and the guide plate 110 can simply be placed on the panel to be mounted. Once the securement mechanism 120 is in place, the device 100 is aligned with the roof frame member providing guidance on the positioning of the fasteners. It is anticipated that the securement mechanism 120 may be straps, a clamp or other mechanisms that can secure the guide plate 110 to one of the roof frame members without departing the spirit of the disclosure.

Referring to FIGS. 3 to 6, in-use views of the device 100 are presented herein to further demonstrate methods of using the device 100 and advantages thereof. It is anticipated that several steps may be sequentially interchangeable and equivalent application of one or more permutations of such sequentially interchangeable steps does not alter the spirit of the disclosure in any meaningful way.

Figure 3:
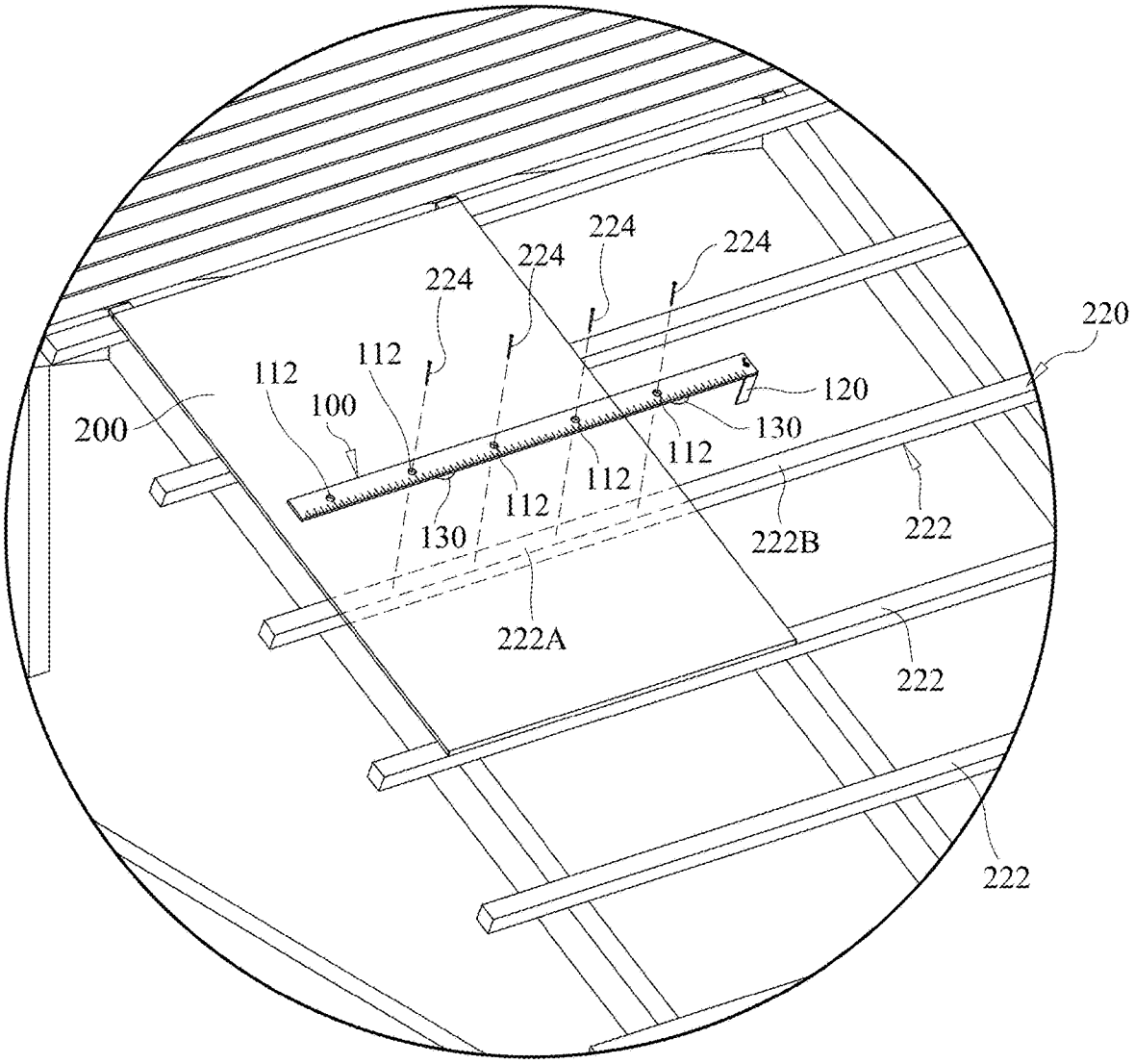
FIG. 3 illustrates a first in-use view of the device of FIG. 1.
Figure 4:
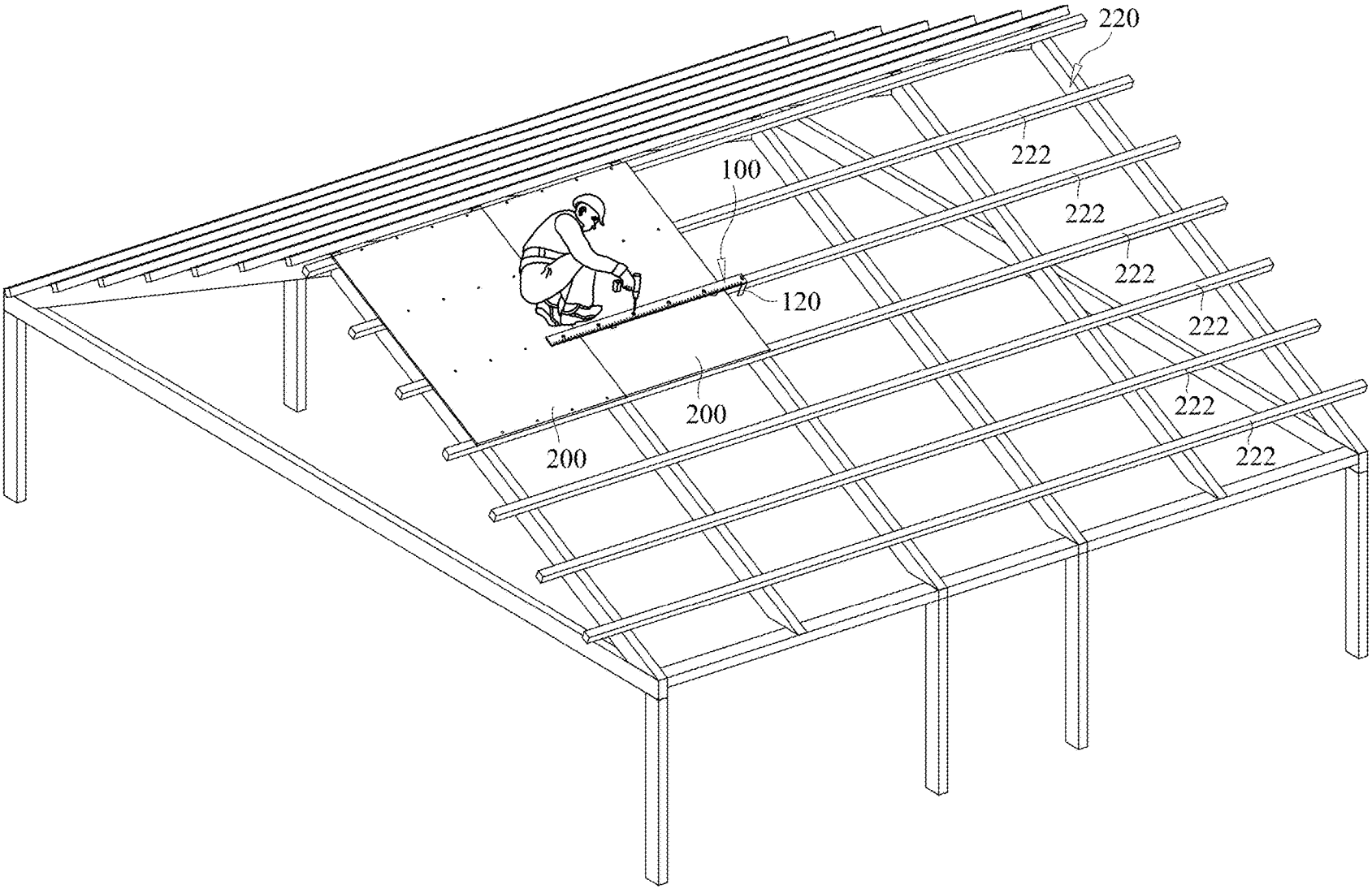
FIG. 4 illustrates a second in-use view of the device of FIG. 1.
Figure 5:
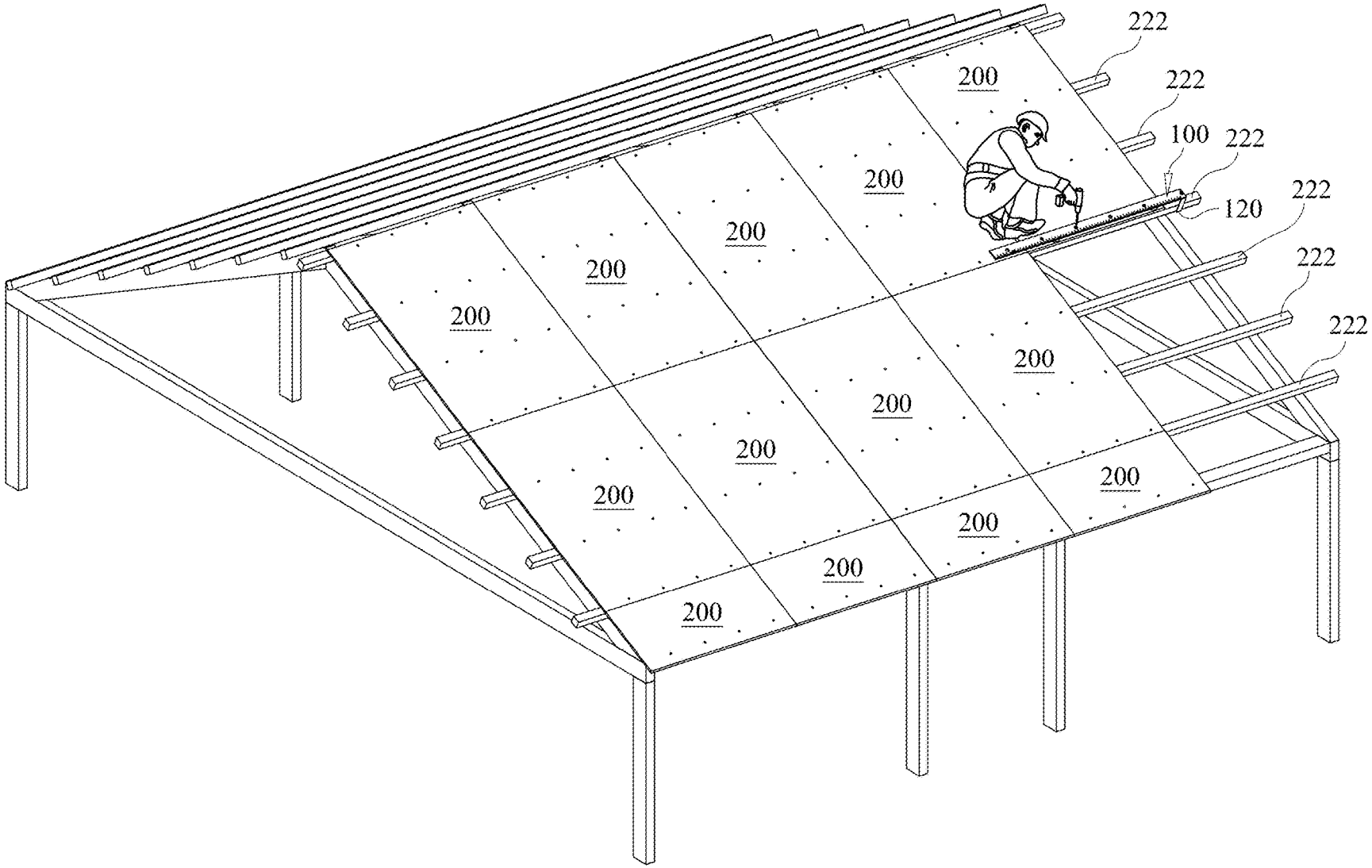
FIG. 5 illustrates a third in-use view of the device of FIG. 1.

Referring to FIGS. 3 to 5, the securement mechanism 120 is in the first position (i.e., the width W2 of the extension 124 parallel to the length L1 of the guide plate 110). As shown in FIG. 3, one or more roof frame members 220 can comprise a plurality of horizontal frame members 222 (i.e., purlins) and a first roof panel 200 (which can be metallic) is positioned upon a portion of the roof frame members 200 for installation. To secure the first roof panel 200 to an underlying portion 222A of one of the horizontal frame members 222, an installer may place the securement mechanism 120 to a visible portion 222B of the horizontal frame member 222 that is adjacent to the underlying portion 222A of the horizontal frame members 222, and then place the guide plate 110 upon the first roof panel 200. The magnets 130 of the guide plate 110 are attached to the metallic first roof panel 200. As the gripping dimension of the securement mechanism 120 is designed to correspond to a corresponding dimension of the horizontal frame member 222, the guide plate 110 is properly positioned once the securement mechanism 120 holds onto the horizontal frame member 222. The installer may then use the apertures 112 as reference points for screwing or nailing fasteners 224 for securing the first roof panel 200 to the horizontal frame member 222. Each aperture 112 of the plurality of apertures has a diameter greater than a diameter of the fastener 224. Therefore, upon completion of securing the fasteners 224, the device 100 may be repositioned for securement of subsequent roof panels 202, as shown in FIGS. 4 and 5. FIGS. 4 and 5 illustrate the installer securing the roof panels 200 to the roof frame members 220. Notably, the roof panels 200 are properly aligned, and the fasteners 224 (shown in dots) are evenly space apart on each of the roof panels 200.

Figure 6:
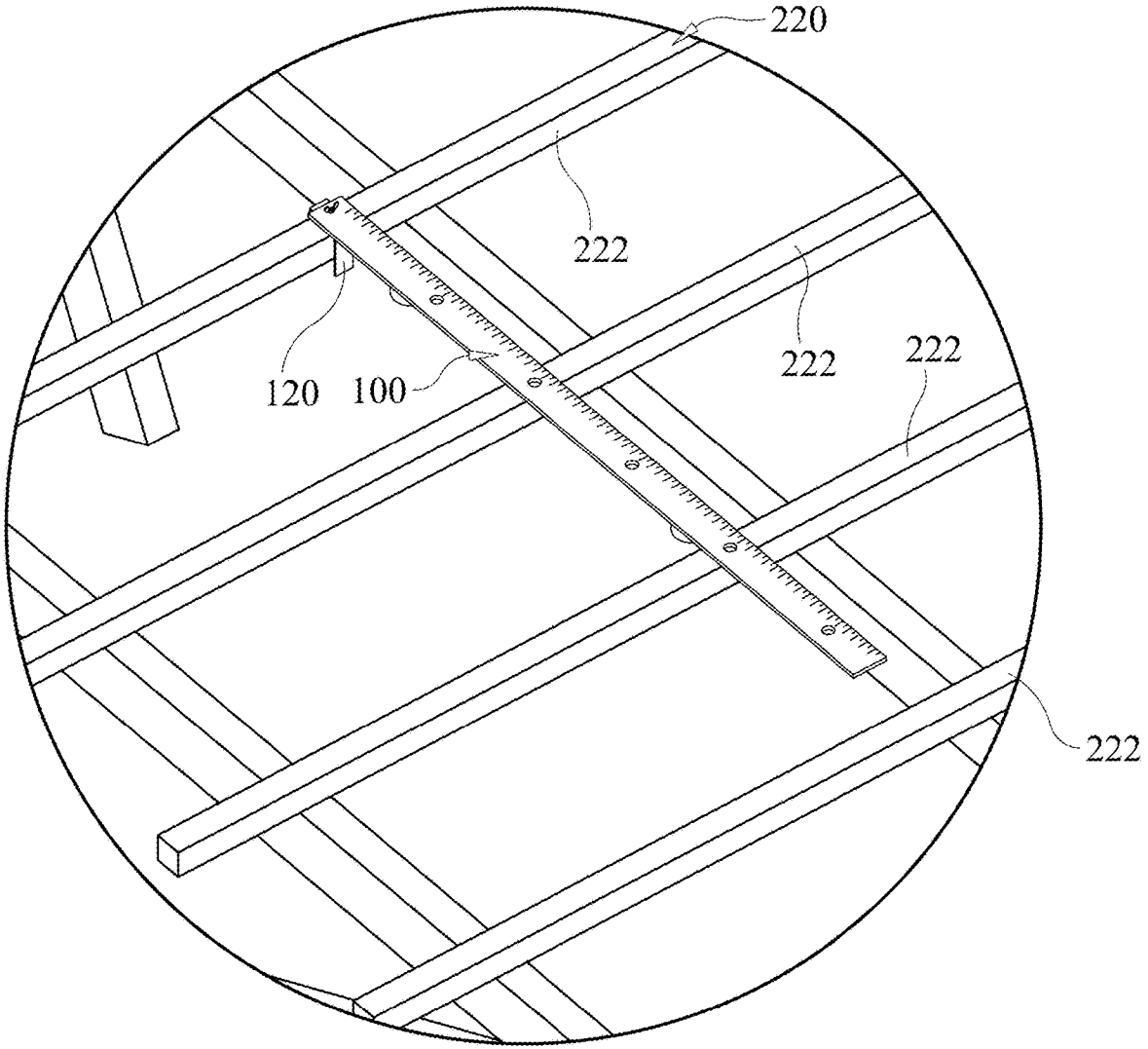
FIG. 6 illustrates a fourth in-use view of the device of FIG. 1.

Referring to FIG. 6, the securement mechanism 120 is in the second position (i.e., the width W2 of the extension 124 perpendicular to the length L1 of the guide plate 110). The installer may place the securement mechanism 120 onto one of the horizontal frame members 222 and place the guide plate 100 in a position perpendicular to the horizontal frame members 222. The increments on the guide plate 100 can then be read to measure a distance between the adjacent horizontal frame members 222.

The disclosed device 100 not only offers a convenient and efficient solution for roof panel alignment and installation, but also advantageously provides a secondary function for measurements.

While the embodiments of the disclosure have been disclosed, certain modifications may be made by those skilled in the art to modify the disclosure without departing from the spirit of the disclosure.

What is claimed is:

1. A device for roof panel alignment, the device comprising:

a longitudinal guide plate comprising a plurality of apertures spaced apart from each other and boring through the longitudinal guide plate;

wherein the longitudinal guide plate has measurement increments along a length thereof; and a securement mechanism coupled to a first end of the longitudinal guide plate for rotation between a first position and a second position perpendicular to the first position, the securement mechanism being rotatable about an axis orthogonal to the longitudinal guide plate.

2. The device of claim 1, wherein the longitudinal guide plate has a substantially rectangular configuration.

3. The device of claim 1, wherein the securement mechanism comprises two extensions extending orthogonally from the longitudinal guide plate.

4. The device of claim 1, further comprising a lockable rotating mechanism configured to couple the securement mechanism to the longitudinal guide plate, the lockable rotating mechanism further configured to restrict rotation of the securement mechanism when tightened and allow rotation of the securement mechanism when loosened.

5. The device of claim 1, wherein the longitudinal guide plate further comprises at least one magnet.

6. The device of claim 1, wherein the plurality of apertures are aligned along a longitudinal axis of the longitudinal guide plate.

7. The device of claim 1, wherein the plurality of apertures comprises five apertures.

* * * * *